US006394634B2

(12) United States Patent
Kitchin

(10) Patent No.: US 6,394,634 B2
(45) Date of Patent: May 28, 2002

(54) MANUALLY ADJUSTABLE BOAT LIGHT

(75) Inventor: Robert S. Kitchin, Clover, SC (US)

(73) Assignees: Lawrence C. Kitchin, York, SC (US); Roger M. Webb, Mt. Holly, NC (US)

( * ) Notice: Subject to any disclaimer, the term of this patent is extended or adjusted under 35 U.S.C. 154(b) by 0 days.

(21) Appl. No.: 09/790,130

(22) Filed: Feb. 21, 2001

Related U.S. Application Data

(60) Provisional application No. 60/185,437, filed on Feb. 28, 2000.

(51) Int. Cl.[7] ..... B63B 45/00

(52) U.S. Cl. ..... 362/477; 362/250; 362/287; 362/419; 362/427; 362/530; 114/343

(58) Field of Search ..... 362/477, 523, 362/529–532, 387, 399, 413, 419, 427, 431, 250; 114/343

(56) References Cited

U.S. PATENT DOCUMENTS

| | | | | | |
|---|---|---|---|---|---|
| 2,410,365 | A | * | 10/1946 | Sauer | 362/530 |
| 3,409,767 | A | | 11/1968 | Entwistle | 362/401 |
| 4,419,721 | A | * | 12/1983 | Gregoire et al. | 362/530 |
| 4,827,389 | A | | 5/1989 | Crum | 362/388 |
| 4,884,173 | A | | 11/1989 | Cassidy | 362/477 |
| 5,126,928 | A | | 6/1992 | Hughes | 362/287 |
| 5,142,457 | A | * | 8/1992 | Wehner | 362/477 |
| D330,266 | S | | 10/1992 | Lin | D26/65 |
| 5,235,500 | A | | 8/1993 | Sapper | 362/426 |
| 5,335,149 | A | | 8/1994 | Evans | 362/477 |
| 5,370,348 | A | | 12/1994 | Toth | 248/289.1 |
| 5,508,895 | A | * | 4/1996 | Wagoner, Jr. | 362/477 |
| 5,704,704 | A | | 1/1998 | Reichard | 362/1 |
| D393,732 | S | | 4/1998 | Rubenzer | D26/65 |
| D414,577 | S | | 9/1999 | Huang | D26/65 |
| D419,255 | S | | 1/2000 | Jehs | D26/65 |
| D419,711 | S | | 1/2000 | Jehs | D26/65 |
| 6,019,484 | A | | 2/2000 | Seyler | 362/287 |
| 6,019,489 | A | * | 2/2000 | Wiggerman | 362/477 |
| 6,039,464 | A | | 3/2000 | Esprit | 362/477 |
| 6,164,803 | A | * | 12/2000 | Reniger et al. | 362/477 |

* cited by examiner

*Primary Examiner*—Alan Cariaso

(57) ABSTRACT

A boat light apparatus comprising a mounting block, a main upright pole, a lamp boom, a main head lamp and a bait lamp. The apparatus has a generally tubular shaped lamp boom with a distal end, proximal end and mid-region. The head lamp is attached to the distal end of the lamp boom and the bait lamp is attached along the lamp boom behind the head lamp. On the proximal end of the lamp boom is a grip handle perpendicular to the lamp boom. The lamp boom is pivotally attached in its mid-region to the main upright pole. This pivotal attachment allows the head lamp to be positioned along the vertical plane. The main upright pole is generally a tubular shaped mast with a top end and bottom end. The lamp boom is pivotally attached near the top end of the upright pole. The bottom end of the upright pole is coupled to a mounting block. The mounting block has an inner cavity to receive the bottom end of the upright pole and allows horizontal rotation of the head lamp. The mounting block is attached to the boat and provides a releasable means of attachment for the main upright pole. The handle on the proximal end of the lamp boom is used to manually position the light beam emitted from the head lamp. The lamps are wired and electric power is routed through a control switch used to turn either lamp on or turn the apparatus off.

4 Claims, 7 Drawing Sheets

MANUALLY ADJUSTABLE BOAT LIGHT

CROSS-REFERENCE TO RELATED APPLICATIONS

This non-provisional application relates to a provisional application No. 60/185,437 filed on Feb. 28, 2000.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Navigating on water at night can be dangerous due to debris, other watercraft and indistinguishable landmarks. Accidents are sometimes unavoidable due to the limited visibility in darkness. Every year people die during nighttime boating accidents when this could possibly be prevented. The subject apparatus relates to such apparatus that increases safety during night fishing, evening pleasure trips and water recreation. The scope of the invention is to provide a boat driving light with a rapidly adjustable azimuth and elevation, such apparatus that can be manually adjusted and operated with one hand, being easy to use, quickly mounted and easily removed for storage when not in use.

The present invention relates to a driving light for a boat. The apparatus relates to such headlamp that is manually controlled and adjustable to conform with various trim angles, pitch and movement experienced by the boat. An additional feature of the present invention is a courtesy light or bait light providing illumination of the boat deck at a lower power requirement making the fishing period safer.

The prior art relating to the subject includes a variety of marine lights and other manually adjustable lights. However, these prior art do not operate in the same manner as the subject or have the features presented in the subject apparatus.

Examples of manually adjustable lights are disclosed in U.S. patents presented by Lin U.S. Pat. No. D330,266, issued Oct. 13, 1992; Rubenzer U.S. Pat. No. D393,732 issued Apr. 21, 1998; Huang U.S. Pat. No. D414,577 issued Sep. 28, 1999; Jehs et al. U.S. Pat. No. D419,255 issued Jan. 28, 2000; Jehs et al. U.S. Pat. No. D419,711 issued Jan. 25, 2000; Seyler U.S. Pat. No. 6,019,484 issued Feb. 1, 2000; Entwistle U.S. Pat. No. 3,409,767 issued Nov. 5, 1968; Hughes U.S. Pat. No. 5,126,928 issued Jun. 30, 1992; and, Sapper U.S. Pat. No. 5,235,500 issued Aug. 10, 1993. These lights are examples of lights designed for indoor use. These lamps are examples of table lamps, floor lamps and the invention by Hughes is a boom mounted shop light. The present invention is designed specifically for marine use. It is the clear intent of these prior art to be in-door lamps. It is not reasonable to assume that these inventors have any other intent or that these prior art could be readily converted to serve the same purpose as the subject. The modifications required to convert these prior art to satisfy the scope of the subject would make them different inventions altogether.

Examples of marine lights are disclosed in US Patents presented by Evans in U.S. Pat. No. 5,335,149 issued Aug. 2, 1994; Toth in U.S. Pat. No. 5,370,348 issued Dec. 5, 1994; Esprit U.S. Pat. No. 6,039,464 issued Mar. 21, 2000; Reichard et al, U.S. Pat. No. 5,704,704 issued Jan. 6, 1998; Cassidy U.S. Pat. No. 4,884,173 issued Nov. 28, 1989; and, Crum U.S. Pat. No. 4,827,389 issued May 2, 1989. These boat lights are designed, operated and function in manners different from the subject. The subject is designed so that the light beam can be quickly and easily placed on the desired heading. The operation and functional design of the subject is unique to the field and superior to these prior art.

A unique feature of the subject is the incorporation of two separate lights, one for the primary purpose to be used when driving and the other as a bait light for the purpose of a courtesy light to be used when not moving.

Another unique feature is the design of the mounting block and working parts that provide a releasable means of attachment, so that the apparatus can be quickly mounted for use or removed for storage.

Another unique feature is the manner and operational function in which the light beam is positioned and repositioned. The mount allows for horizontal rotation of the light beam and the pivotal connection between the lamp boom and upright pole allows for vertical rotation of the light beam. The elements and working parts provide a means of holding the light beam in place once the apparatus is repositioned. No other marine light could be found with these particular embodiments which are unique to this invention.

Another unique feature of the subject is the 90 degree turn on the proximal end of the lamp boom allowing this end to become a handle grip. No other marine lights could be found with this feature. Seyler in U.S. Pat. No. 6,019,484 provides a slight bend (not 90 degrees) in the proximal end of the boom to be used as a handle grip. However, the apparatus by Seyler is a floor lamp with a wheeled base and fluorescent tube light. The intended use and scope of Seyler's apparatus is unlike to the subject. Also, the single pole double throw switch used to operate both the headlamp and bait light is recessed in the handle of the present invention. This feature increases the subject's convenience in that the desired lamp can be turned on with the same hand being used to operate the apparatus and position the lamp beam.

An exhaustive search has been made of the prior art and the marketplace to find an apparatus comparable to the subject. No such device could be found that provides the conveniences, features, benefits and functional utility offered by the present invention. The present invention vastly increases safety during nighttime boating and thus, it is worthwhile for boaters to have such apparatus. Therefore, it is found that there is a present need for the subject invention.

BRIEF SUMMARY OF THE INVENTION

The objective and primary purpose for the present invention is to make a driving light for safe night boating, to protect people and their boats, as well as, other property. A secondary purpose for the present invention is to provide a bait light as a convenience and courtesy light. The function of the apparatus is to allow a manual adjustment of the azimuth and elevation of the light beams from either the main lamp or the bait lamp. The main lamp beam can be adjusted very quickly, so the operator can move the boat safely through debris, rocks, or a heavily traveled waterway. The apparatus is designed to be manually operated with only one hand and fulfills its purpose providing an effective and easy to use boat light.

The invention has a mount which is secured to the side wall of the boat. The mount provides a stable foundation for the apparatus and designed so the apparatus can to be rotated in the azimuth plane through 360 degrees. The bottom of the main upright pole fits into the mount. A securing knob on the mount is turned and its screw engages a detent near the bottom on the main pole. This securing knob screw keeps the main upright pole from coming out of the mount when in use. A power cord from the main upright pole fits down through the primary hole in the mount and is attached to the power supply via a connector. When not in use the apparatus is removed by turning the securing knob which disengages its securing screw from the detent on the main upright pole. The power cord is disconnected and the apparatus is simply lifted out of the mount.

Pivotally attached to the main upright pole is the lamp boom. On the distal end of the lamp boom is the headlamp, followed by the bait light. The proximal end of the lamp boom has a 90 degree turn for a handle. The pivot point on the lamp boom is located at a desired point in the area between the lamp and handle in the same fashion as a Class I Lever. The corresponding pivot point on the main upright pole is located in the area near the top of the main upright pole. The light beam is easily adjusted by gripping the handle and moving the lamp boom to place the light beam in the desired direction.

Another pivotal connection is located at the junction of the headlamp and the lamp boom. The intent of this pivotal connection is for the headlamp to be adjusted to a fixed angle typically about 150 degrees to the lamp boom. The pivotal connection of the headlamp to the lamp boom allows this angle to be custom fit and intended to be a one time adjustment. The adjustment of the light beam while driving is not by this pivotal connection, rather by using the handle to adjust the lamp boom.

Recessed in the end of the handle is a single pole double throw switch with center off position. The wiring for the apparatus is located inside the main upright pole and lamp boom. The wiring only extends out of the pole and boom at the two pivotal points which allows the slack for rotation. The wire extends out of the bottom of the main upright pole and goes through the mount to a connection providing electric power.

DETAILED DESCRIPTION OF THE INVENTION

Figure 1:
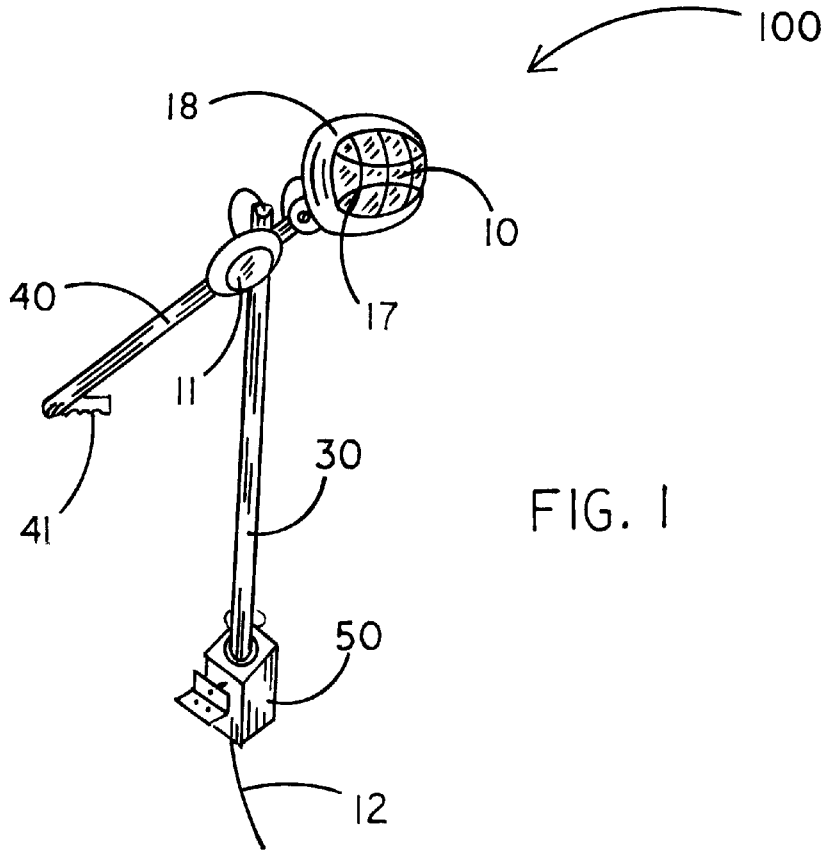
FIG. 1 is a perspective view of the subject apparatus.
Figure 2:
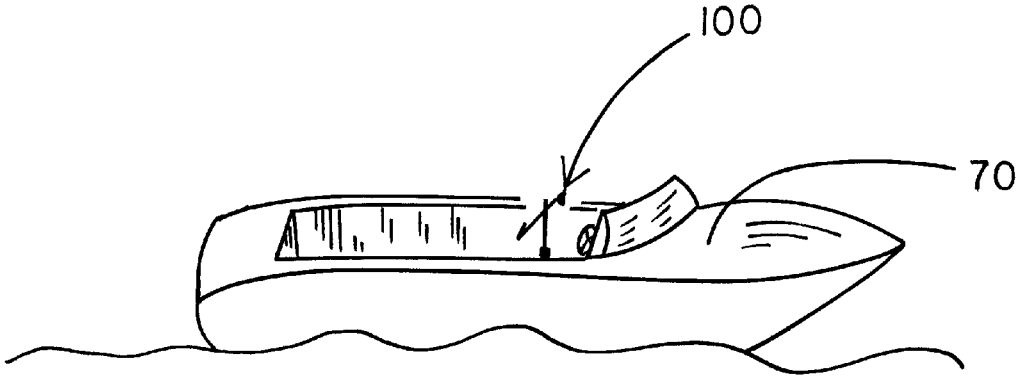
FIG. 2 is a perspective view of the subject apparatus being attached to a boat.

FIGS. 1 through 10 disclose the preferred embodiments of the subject apparatus. FIG. 2 provides a perspective view of the present invention 100 in the operating position attached at the cockpit area of the boat 70.

FIG. 1 is a perspective view of the present invention 100. The head lamp 10 is recessed in a case 18 with a protective guard 17 in front of the head lamp 10. The head lamp is capable of emitting a generally directed light beam. The protective guard 17 attaches to the case 18 as depicted in FIG. 1. The protective guard 17 provides an element of safety for the headlamp 10 from hitting an object or flying debris, as well as, prevent a burn from a hand or arm touching a hot headlamp 10. The headlamp case 18 is attached to the distal end of the lamp boom 40. The lamp boom 40 is generally a tubular hollow shaft with a distal end, proximal end and mid-region. A bait light 11 is capable of emitting a generally diffused light. The bait light 11 is attached to the lamp boom 40 in the area along the lamp boom 40 behind the headlamp case 18 as depicted in FIG. 1. At the proximal end of the lamp boom 40 is a handle 41. The lamp boom 40 is pivotally attached to a main upright pole 30. The main upright pole is a generally a vertically oriented mast pipe with a hollow shaft. The main upright pole 30 is secured to the boat by a mounting block 50. The electric wires 12 that provide a power supply are routed inside the lamp boom 40, the main upright pole 30 and extend down through and out of the mounting block 50.

Figure 3:
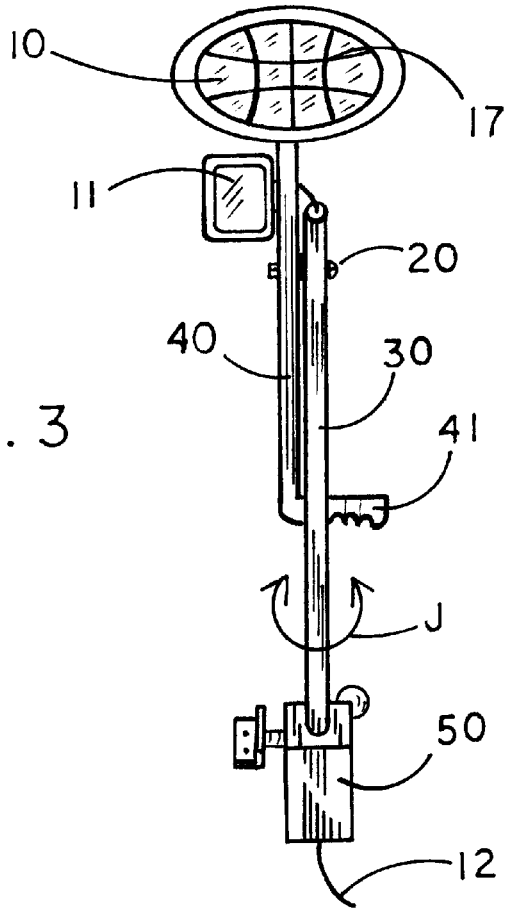
FIG. 3 is a front view of the subject apparatus.

FIG. 3 provides a front view of the invention. The design of the protective guard 17 is in the form of a cage and can be made from wire, heat-resistant plastic or other satisfactory heat-resistant materials. As depicted the cage being the protective guard 17 covers the headlamp 10. The bait lamp 11 and the headlamp 10 are attached to the lamp boom 40. The lamp boom 40 is attached to the main upright pole 30 with a pivotal bolt 20. The proximal end of the lamp boom 40 is the grip handle 41 which is perpendicular to the lamp boom 40. The main upright pole 30 fits into a cavity in the mounting block 50. The manner of attachment of the main upright pole 30 to the mounting block 50 allows rotation of the main upright pole 30 through 360 degrees azimuth as depicted by action arrow "J" in FIG. 3. In this manner the operator is able to position the beam from the headlamp 10 anywhere along the horizontal plane. The electric wire 12 is shown coming down out of the mounting block 50.

Figure 4:
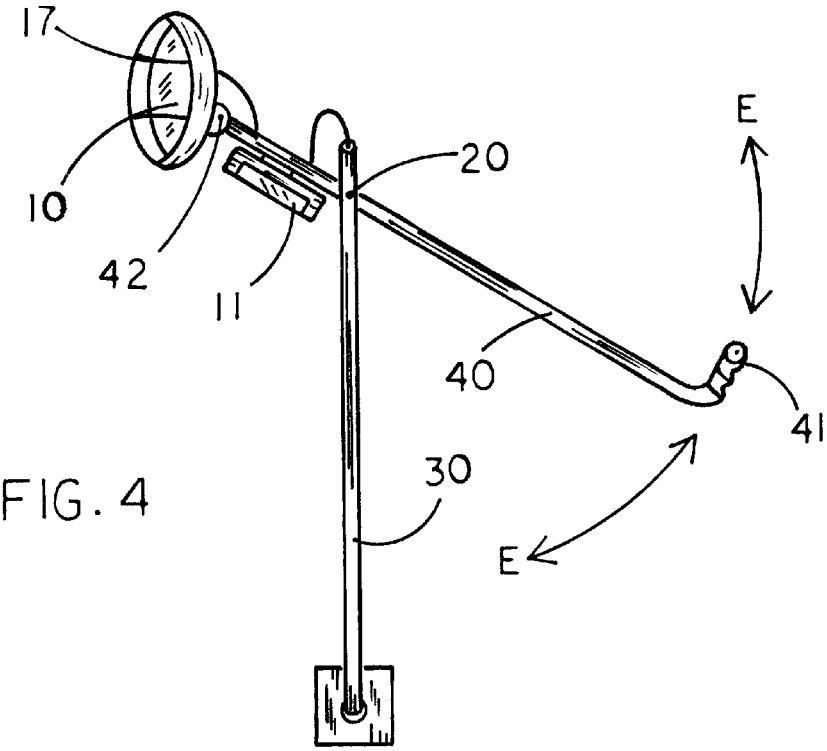
FIG. 4 is a side view of the left side of the apparatus.

FIG. 4. is a left side view of the invention. As in the previous drawings, FIG. 4. shows the headlamp 10 and protective guard 17. FIG. 4 shows a headlamp pivotal bolt 42 which joins the headlamp 10 to the lamp boom 40. The bait lamp 11 is shown attached to the lamp boom 40. The lamp boom 40 is pivotally attached to the main upright pole 30. The pivotal bolt 20 allows the lamp boom 40 to be rotated in relation to the main upright pole 30. The operator grips the handle 41 and moves it along action arrow E, shown in FIG. 4, to the desired position. Thus, elevation of the headlamp 10 through a wide angular range is achieved. The light beam from the headlamp 10, as well as, the light beam from the bait lamp 11 is directed in this manner.

Figure 5:
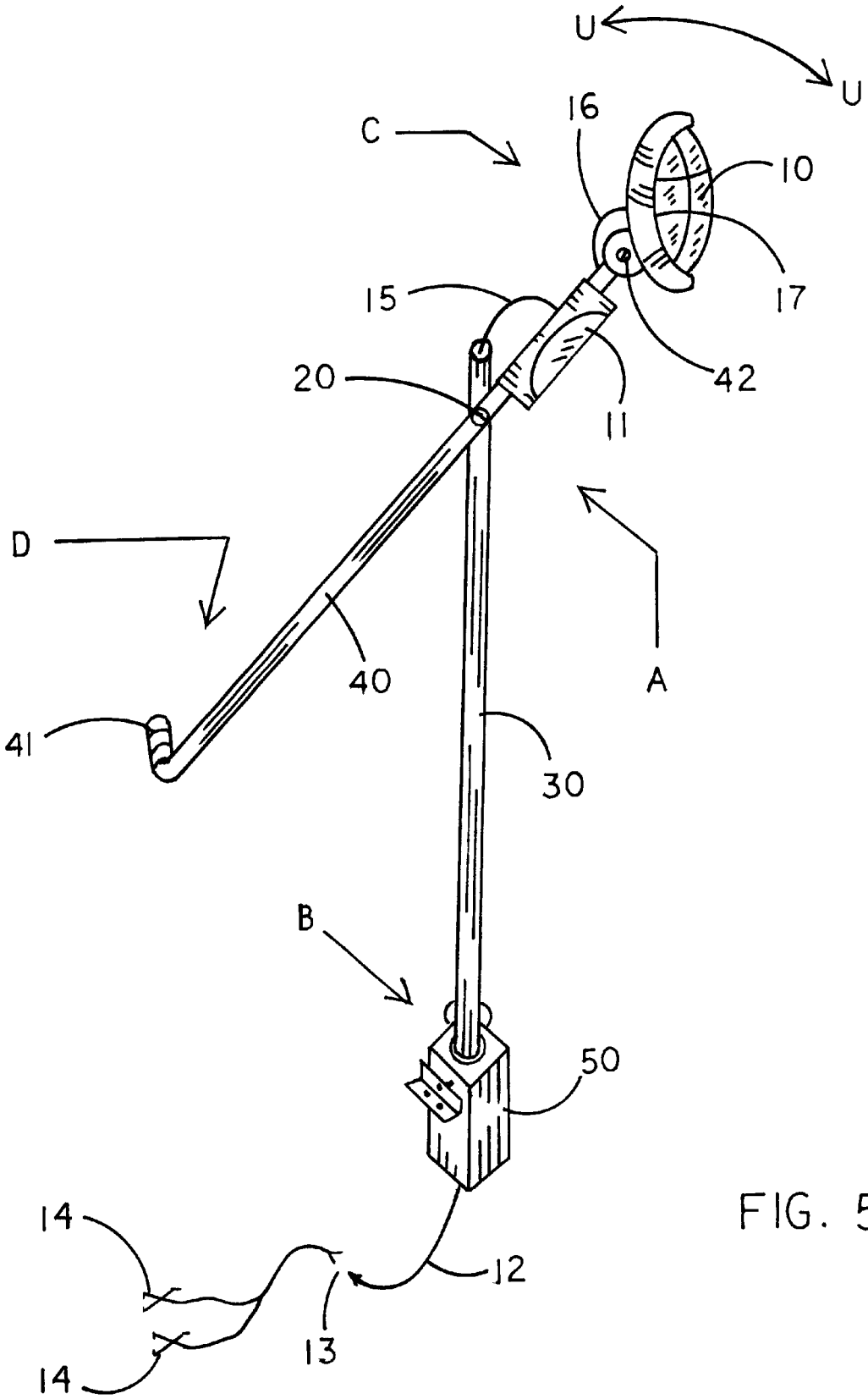
FIG. 5 is a side view of the right side of the apparatus.

FIG. 5 is a right side view of the invention. The protective guard 17 is shown over the headlamp 10. The bait lamp 11 is attached to the lamp boom 40. The headlamp 10 is attached to the lamp boom 40 by a headlamp pivotal bolt 42. The headlamp pivotal bolt 42 allows an adjustment of the angular relationship between the headlamp 10 and lamp boom 40 as depicted by action arrow "U" in FIG. 5. This adjustment is intended as a one time adjustment to custom fit the present invention to a particular boat. A curved loop of wire 16 extends between the headlamp 10 and lamp boom 40 allowing slack for this adjustment. A similar curved loop of wire 15 extends between the lamp boom 40 and the main upright pole 30 which allows slack for rotation of these elements on the pivotal bolt 20 during typical operation of the invention. Attention is given to waterproofing these curved wires 15 and 16, as well as, their entry point into the body of the apparatus.

In FIG. 5 the pivotal bolt 20 is shown which attaches the lamp boom 40 to the main upright pole 30. The arrow "A" points to this pivotal area and is shown in greater detail in FIG. 6. In FIG. 5 The arrow "B" points to the mounting block 50 and is shown in greater detail in FIG. 7. In FIG. 5 the arrow "C" points to the connection of the headlamp to the lamp boom and is shown in greater detail in FIG. 8. In FIG. 5 the arrow "D" points to the handle 41 and is shown in greater detail in FIG. 9.

FIG. 5 shows the electric wire 12 extending down and out of the mounting block 50. The electric wire 12 is terminated with a connector 13. The connector 13 allows connection to wires terminated with alligator clips 14. These alligator clips 14 are shown for disclosure purposes. Other suitable means of connection can be made to a battery or power supply. The connector 13 allows the invention to be removed from the mounting block 50. Thus, the upper portion of the apparatus can be safely stored when not in use.

Figure 6:
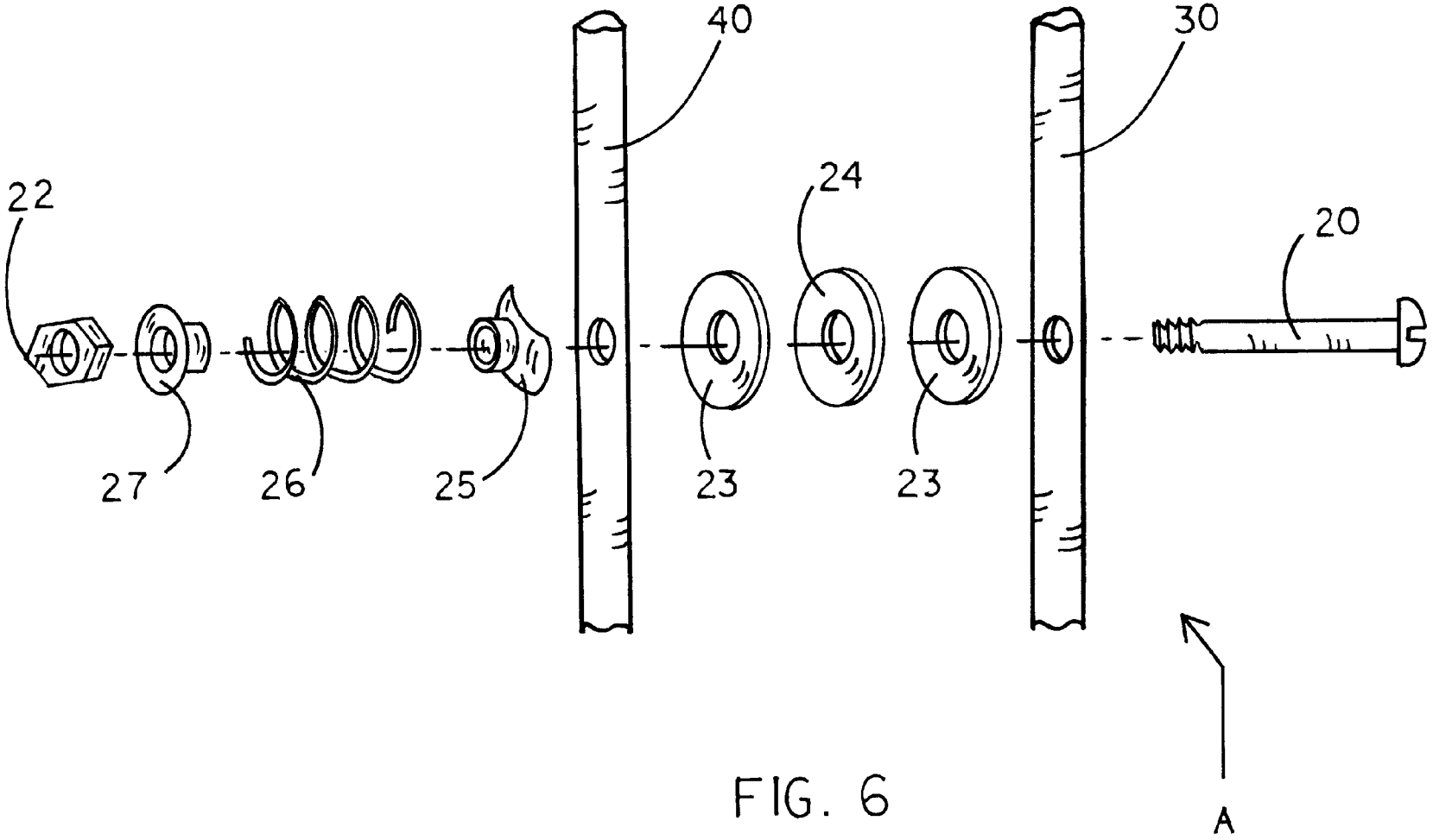
FIG. 6 is a partial view "A" as indicated on FIG. 5. showing the assembly of the pivotal connection between the main upright pole and the lamp pole.

FIG. 6 shows the pivotal point between the main upright pole 30 and the lamp boom 40. The pivotal bolt 20 passes through the main upright pole 30. Between the main upright pole 30 and the lamp boom 40 are a series of washers. A polysynthetic washer 24 is sandwiched between metal washers 23. The expansion coefficient differential between these materials provides friction necessary to hold the adjusted position of the lamp boom 40 relative to the upright pole 30. A saddle washer 25 conforms to the curve shape of the lamp boom 40 and has a spacer fitting into a spring 26. A spacer washer 27 fits the spring 26 at the distal aspect. As depicted in FIG. 6 the pivotal bolt 20 passes through these elements and is secured by a nut 22. The friction between the washers 23 and 24 along with the tension provided by the spring 26 allows that when the lamp boom 40 is rotated its position relative to the main upright pole 30 is held in place. Therefore, when the elevated direction of the lamp beam is A changed during operation it is fixed, but can be quickly repositioned as necessary. If desired the washers 23 can be joined to the upright pole 30 and lamp boom 40 with pop rivets or other such method of joining.

Figure 7:
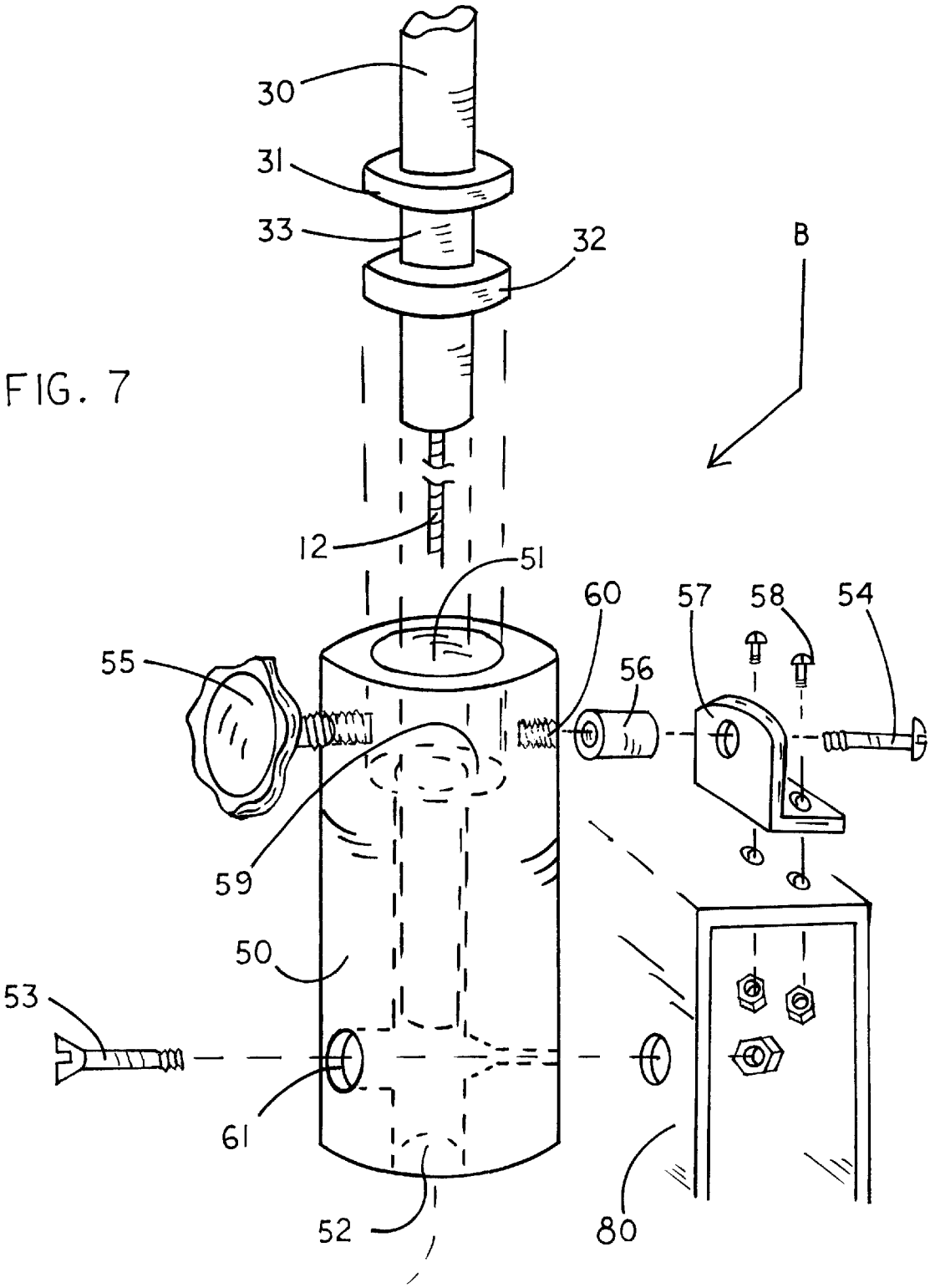
FIG. 7 is a partial view "B" as indicated on FIG. 5. showing details of the mount for the subject.

The arrow "B" in FIG. 3 relates to the mounting block that is disclosed in FIG. 7. FIG. 7 is a detailed view of the mounting block 50. An inner cavity in the mounting block has a large opening 51 at the top and a smaller opening 52 at the bottom. The transition of the larger opening 51 to the smaller opening 52 forms an inner seat 59. The mounting block 50 receives the lower end of the main upright pole 30. The power cord 12 extends from inside the main upright pole 30 down through the inner cavity of the mounting block and comes out the bottom of the block at the smaller opening 52. The power cord 12 can then be connected to the power supply. A portion of the main upright pole 30 fits into the smaller area of the inner cavity so that the lower ring 32 sits on the inner seat 59 and provides a bearing for the main upright pole 30 on the mounting block 50. In this position, the securing knob 55 is turned and engages the detent 33 formed between the lower ring 32 and the upper ring 33 on the main upright pole 30. Thus, the securing knob 55 prevents the lower ring 32 from coming up. Thus, the main upright pole 30 and body of the apparatus is prevented from coming out of the mounting block, while at the same time allowing the main upright pole to be rotated in the azimuth plane. If the operator wishes to fix the direction of the light beam the securing knob 55 can be turned tight against the detent 33 which will then prevent the horizontal rotation of the main upright pole 30. By loosening the securing knob 55 so that it is not tight against the detent 33 will allow for horizontal rotation. In this manner the securing knob 55 serves two purposes. When the apparatus is removed for storage, the securing knob 55 is turned so that it screws out of the inner cavity and disengaging the lower ring 32 allows the main upright pole 30 and the body of the apparatus to be lifted out of the mount. The mounting block 50 as disclosed in FIGS. 1, 3, 5 and 7 provides a releasable means to attach the apparatus to a boat.

FIG. 7 shows that the mounting block 50 is attached to the side wall 80 of the boat using the lower bolt 53 and the upper bolt 54. The lower bolt 53 passes through the lower bolt hole 61. The lower bolt 53 has a counter-sink head which is recessed into the side wall of the inner cavity of the mounting block. Thus, the lower bolt 53 does not inhibit movement of the main upright pole 30. The lower bolt 53 is attached with a nut as depicted in FIG. 7. The upper bolt 54 passes through a bracket 57 then a spacer 56 and then into a threaded hole 60 on the mounting block 50. The threaded hole 60 does not pass into the inner cavity of the apparatus, but is threaded and cut to accept the upper bolt 54. The bracket 57 is attached to the top of the side wall 80 of the boat using bolts 58 and secured as depicted in FIG. 7. The bracket and spacer can be inverted, position switched or modified in such fashion to custom fit a particular boat. Also, various means of joining can be employed to secure the mounting block 50 to the side wall 80 of the boat. The embodiment disclosed herein is merely intended to display a method of attachment.

Figure 8:
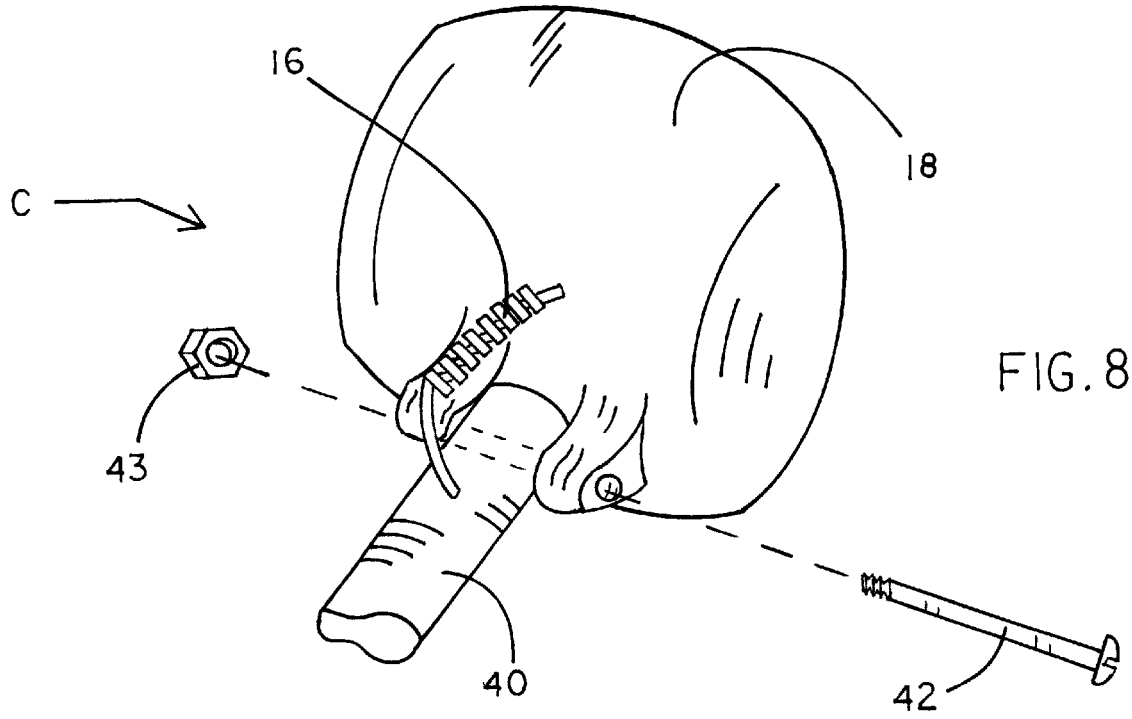
FIG. 8 is a partial view "C" as indicated on FIG. 5. showing the pivotal connection.

FIG. 8 shows a partial view being the distal end of the lamp boom 40 as shown by the arrow "C" in FIG. 4. In FIG. 8 the headlamp case 18 is attached to the lamp boom 40 with a bolt 42 and nut 43. This allows the position of the lamp to be varied to the lamp boom 40, however, it is intended to be a one time adjustment. The loop wire 16 allows slack in the wire for this one time adjustment. Attention is given to waterproofing the loop wire 16, as well as, its entry points into the lamp case 18 and lamp boom 40.

Figure 9:
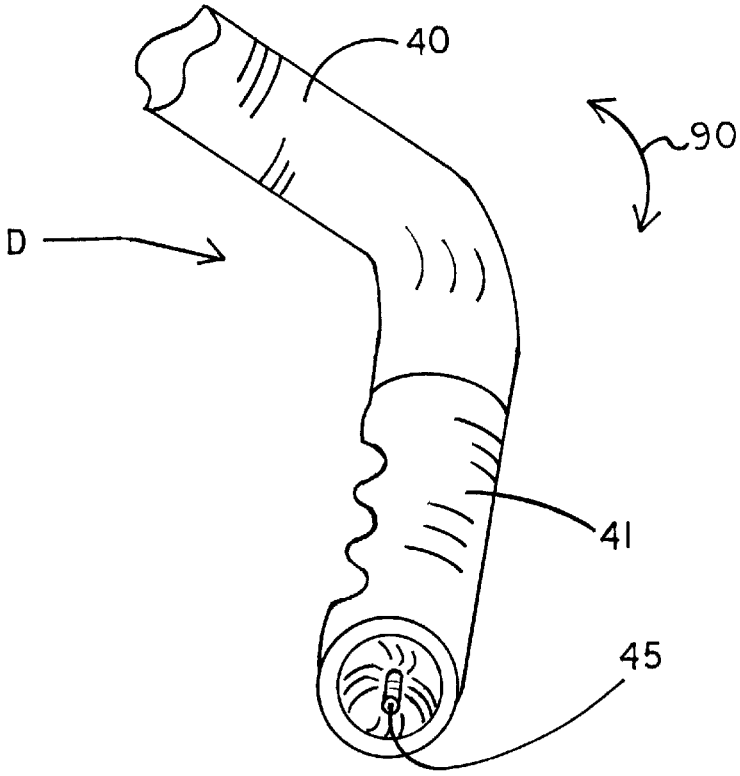
FIG. 9 is a partial view "D" as indicated on FIG. 5. showing the handle.

FIG. 9 shows a partial view being the proximal end of the lamp boom 40 shown by the arrow "D" in FIG. 4. FIG. 9 shows the handle 41 which is the grip used to operate the present invention. The handle 41 is perpendicular to the lamp boom 40 as shown by the arrow 90. A single pole double throw switch 45 with center off position is shown recessed into the handle 41. Position 1 of the switch closes the circuit of the main headlamp. Position 2 of the switch closes the circuit of the bait lamp. The center position of the switch is the off position.

Figure 10:
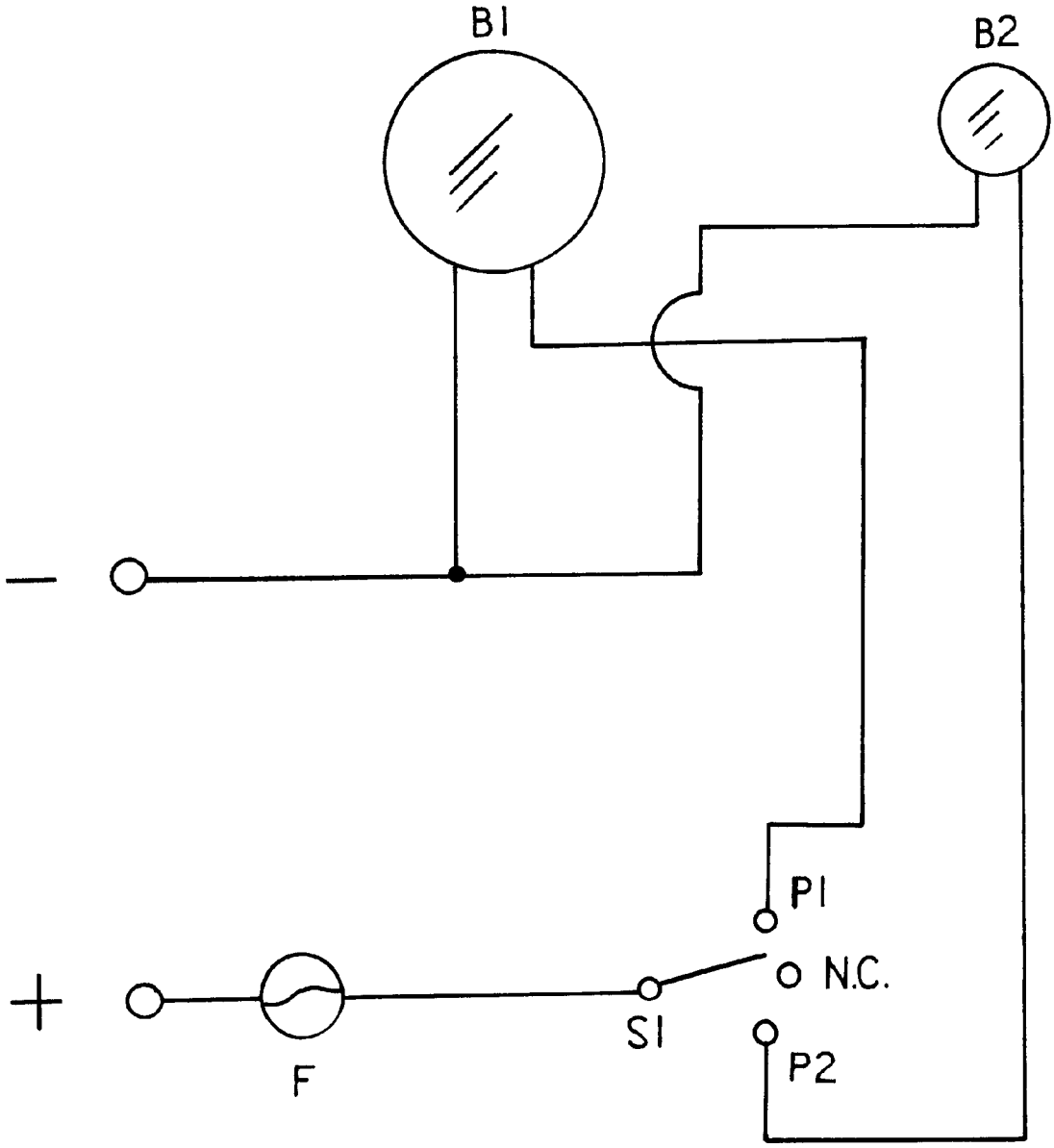
FIG. 10 is a schematic diagram showing the electrical wiring of the apparatus.

FIG. 10 is a schematic diagram of the wiring for the present invention. The plus and minus symbols represent the power supply, the circuit is fused "IF" with a fuse or circuit breaker, and, "S1" relates to the switch. Position 1 "P1" of the switch engages the headlamp "B1". Position 2 "P2" of the switch engages the bait lamp "B2". Position "N.C." being the center position of the switch is no connection or the off position of the apparatus.

The operation and use of the present invention is easy once the mount is secured on the watercraft. The bottom of the main upright pole 30 is placed down into the top of the inner cavity 51 on the mounting block. The securing knob 55 is turned to keep the upright pole from coming up and out of the mounting block. The electric wire is connected to the power source. The handle 41 is then manually adjusted to position the light beam in the desired direction. By changing the position of the handle 41 the beam emitted from the headlamp is changed up or down, side to side, as needed. As the boat is accelerated the front of the watercraft pitches up and with the apparatus the light beam can be quickly adjusted back to the horizon. The wide range of movement provided by the apparatus allows the operator to keep the light beam on the horizon during acceleration, trim and deceleration. This increases safety during travel. The switch in the handle is used to select between the head lamp, bait light or turn the apparatus off. This process is reversed to remove the body of the apparatus from the mount when not in use. If the head lamp is hot a cooling off period of at least 30 minutes should be observed before storing. The apparatus should be stored with care in a dry padded place and restrained from movement so to protect the lamps. The bearing point being the inner seat 59 on the main mount should be occasionally lubricated. The unit is intended for use with low voltage such as a marine battery drawing low current and should not cause a electrical problem or present a safety hazard if properly used. If the head lamp burns out then the bait lamp could be used as a backup. The bait lamp should yield enough light to be sufficient to be used for navigating in a marina, around the dock and close boating for courtesy. The main lamp beam should never be pointed at someone's eyes.

The bait light is shown on the distal aspect of the lamp boom. However, the bait light may be attached to other various parts of the apparatus such as the main upright pole 30 or the head lamp housing 18 as preferred. This smaller light illuminates the boat so the operator can see when stopped. This increases safety during fishing without the use of a hand held light. The bait light is of a lower wattage than the main head lamp and allows for less drain on the battery.

The mounting block 50 as disclosed in FIGS. 1, 3, 5 and 7 provides a releasable means to attach the apparatus to a boat.

The primary purpose of the invention is to make night boating safe to protect life and property. The function of the apparatus is to provide illumination allowing the main lamp beam to be quickly and manually adjusted vertically, as well as, horizontally so the operator can move the boat safely through debris, rocks or a heavily traveled waterway. The apparatus is designed to be operated with only one hand and fulfills its purpose providing an effective and easy to use boat light. Various materials may be used to construct the present invention such as, but not limited to, metal, wood, plastic or other such materials. Elements of the invention may be molded, cast or extruded. As the apparatus will often be exposed to the elements, materials resistant to damage from sunlight should be used. Also, the apparatus should be made as waterproof as possible. Variations and modifications to the apparatus can be anticipated in the manufacture of the apparatus with such decedents to fall within the scope of the present invention. It is not the intent to limit the scope of the invention by the narrative and drawings contained herein.

I claim:

1. A manually adjustable electric driving light and bait light apparatus for a boat useful for illumination to increase safety during nighttime boating, the apparatus comprising:

a) a mount providing a releasable means of attachment for the apparatus to the boat;

b) an upright pole being a vertically oriented mast extending upward from said mount;

c) a lamp boom being a shaft with a proximal end, a distal end, and, a mid-region pivotal connection to the said upright pole;

d) a grip handle attached to the a proximal end of said lamp boom providing a means to manually operate the apparatus;

e) a bait lamp capable of emitting generally diffused light attached to said lamp boom in the distal aspect of said lamp boom;

f) a head lamp connected to the distal end of said lamp boom capable of emitting a directed light beam;

g) electric wire connections providing power supply to the said head lamp, wire connection to said bait lamp and a control switch providing a mutually exclusive means of connecting fused power to the said lamps of the apparatus;

whereby said mount has an inner cavity to receive the lower end of said main upright pole, this coupling provides a means of horizontal 360 degree rotation of said head lamp for positioning the emitted light beam in the azimuth plane by manually adjusting said grip handle; and, whereby said pivotal connection between the said lamp boom and said upright pole provides a means of vertical, up and down, rotation of said head lamp for positioning the emitted light beam in the elevation plane by manually adjusting said grip handle.

2. A manually adjustable light apparatus for a boat useful to increase safety and convenience during nighttime boating, the apparatus comprising:

a mount providing a releasable means of attachment for the apparatus to said boat;

an upright pole vertically oriented from said mount with means of attachment providing horizontal rotation of said upright pole;

a generally shaft shaped lamp boom pivotally attached to said upright pole with means of attachment providing vertical rotation of said lamp boom;

a head lamp attached to the distal end of said lamp boom; and, a handle attached to the proximal end of said lamp boom;

whereby said handle provides a means of manual adjustment for said head lamp.

3. The apparatus of claim 1, whereas the said pivotal connection of the lamp boom to said upright pole has a series of washers providing friction to hold the position of said lamp boom relative to said upright pole when the elevation of said lamp is manually adjusted.

4. The apparatus of claim 2, whereas a second bait light is added to the apparatus for convenience.

* * * * *